US010167147B2

(12) United States Patent
Yamauchi

(10) Patent No.: US 10,167,147 B2
(45) Date of Patent: Jan. 1, 2019

(54) SHEET FEEDER DEVICE AND IMAGE FORMING APPARATUS

(71) Applicant: Konica Minolta, Inc., Chiyoda-ku, Tokyo (JP)

(72) Inventor: Yuki Yamauchi, Nishitokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/403,475

(22) Filed: Jan. 11, 2017

(65) Prior Publication Data

US 2017/0203930 A1 Jul. 20, 2017

(30) Foreign Application Priority Data

Jan. 18, 2016 (JP) ..... 2016-007217

(51) Int. Cl.

| | |
|---|---|
| ***B65H 1/18*** | (2006.01) |
| ***B65H 1/20*** | (2006.01) |
| ***B65H 1/04*** | (2006.01) |
| ***B65H 1/26*** | (2006.01) |
| ***B65H 5/06*** | (2006.01) |
| ***G03G 15/00*** | (2006.01) |
| ***B65H 1/14*** | (2006.01) |
| ***B65H 7/02*** | (2006.01) |

(52) U.S. Cl.

CPC ..... *B65H 1/20* (2013.01); *B65H 1/04* (2013.01); *B65H 1/14* (2013.01); *B65H 1/26* (2013.01); *B65H 5/062* (2013.01); *B65H 7/02* (2013.01); *G03G 15/6529* (2013.01); *B65H 2405/115* (2013.01); *B65H 2405/353* (2013.01); *B65H 2511/11* (2013.01); *B65H 2511/20* (2013.01); *B65H 2701/11312* (2013.01)

(58) Field of Classification Search

CPC ..... B65H 2405/115; B65H 2405/353; G03G 21/1633

See application file for complete search history.

(56) References Cited

U.S. PATENT DOCUMENTS

| | | | | |
|---|---|---|---|---|
| 5,794,928 A * | 8/1998 | Araseki | B65H 1/04 | 271/126 |
| 6,523,821 B2 * | 2/2003 | Kashiwagi | B65H 5/12 | 271/145 |
| 7,029,006 B2 * | 4/2006 | Izumi | G03G 15/6529 | 271/145 |

FOREIGN PATENT DOCUMENTS

| | | | |
|---|---|---|---|
| JP | 2010143736 A | * | 7/2010 |
| JP | 2010143736 A | | 7/2010 |

* cited by examiner

*Primary Examiner* — Howard J Sanders

(74) *Attorney, Agent, or Firm* — Cantor Colburn LLP

(57) ABSTRACT

A sheet feeder device that stores and sends out a transfer medium includes: a sheet feeder device main unit having an opening formed at an upper portion and including an upstream partial lid located on an upstream side and a downstream partial lid located on a downstream side, the upstream partial lid and the downstream partial lid covering at least part of the opening; a sheet feed tray provided in the sheet feeder device main unit, the transfer medium being loaded onto the sheet feed tray; an elevating unit configured to lift up and down the sheet feed tray; and a control unit configured to control the lifting up and down of the sheet feed tray, wherein the control unit senses opening and closing of the upstream partial lid and the downstream partial lid, and controls the lifting up and down being performed by the elevating unit.

19 Claims, 5 Drawing Sheets

SHEET FEEDER DEVICE AND IMAGE FORMING APPARATUS

The entire disclosure of Japanese Patent Application No. 2016-007217 filed on Jan. 18, 2016 including description, claims, drawings, and abstract are incorporated herein by reference in its entirety.

BACKGROUND OF THE INVENTION

Field of the Invention

The present invention relates to a sheet feeder device that conveys a transfer medium, and an image forming apparatus including the sheet feeder device.

Description of the Related Art

In an image forming apparatus that forms an image on a transfer medium and performs printing, a paper sheet is supplied for printing from a sheet feeder device that stores paper sheets. In the sheet feeder device, a sheet feed tray is disposed in a sheet feeding position so that paper sheets are supplied.

In the image forming apparatus, an image is formed on a paper sheet called a long paper sheet in some cases. Unlike a standard paper sheet such as A3 paper or A4 paper, the long paper sheet is long in a predetermined direction. There are long paper sheets having various lengths, such as 660 mm, 750 mm, and 1200 mm. Particularly, there is an increasing demand for mass-printing on long paper sheets up to 660 mm in length these days. To supply a long paper sheet with a low frequency of use, it is necessary to prepare a sheet feeder device that is longer in size than the long paper sheet to be used. Such a sheet feeder device might fail to appropriately store A3 and A4 paper with a high frequency of use.

To counter this, an opening is formed at an upper portion of a conventional sheet feeder device, and a lid is provided to cover the opening. The sheet feeder device includes an elevating means to lift a sheet feed tray up and down in the sheet feeder device main unit. When the lid is located on the upstream side of the upper opening in the conveying direction and forms an obtuse angle with the tray, a long paper sheet that is longer than the tray can be loaded onto the tray and the lid (see JP 2010-143736 A).

In this conventional structure, the opening direction of the lid can be changed, and the elevating tray can be prevented from moving down from the sheet feeding position by a user operating a component related to the lifting up and down of the tray. By this technology, a large number of paper sheets with a high frequency use can be stored, and a long paper sheet that is not frequently used but has a great sheet length can be used while an increase in the size of the machine is prevented.

By the conventional technology, the lowering position of the elevating tray is changed by controlling the opening direction of the lid. However, the user needs to switch the opening direction of the lid when loading paper sheets onto the elevating tray, and needs to switch elevating drive joints or the like, resulting in a troublesome operation. Furthermore, in a case where the lid is opened in a wrong direction, the tray is not lowered even when the user wishes to load a large number of paper sheets onto the tray, or the tray is lowered too far, and a long paper sheet is bent or wrinkled though the user wishes to load the long paper sheet onto the tray.

Furthermore, the lid that covers the opening at the upper portion is also used as the sheet loading means. As a result, while paper sheets are being supplied, the lid might come into contact with a rotating member such as the drive roller for supplying paper sheets, and safety might be undermined.

SUMMARY OF THE INVENTION

The present invention has been made in view of the above circumstances, and an object thereof is to provide a sheet feeder device that covers an opening formed in the sheet feeder device main unit with partial lids, and can control lifting up and down of a sheet feed tray in accordance with opened/closed states of the partial lids and an image forming apparatus.

To achieve the abovementioned object, according to an aspect, a sheet feeder device that stores and sends out a transfer medium, reflecting one aspect of the present invention comprises:

a sheet feeder device main unit having an opening formed at an upper portion, the sheet feeder device main unit including an upstream partial lid located on an upstream side in a conveying direction and a downstream partial lid located on a downstream side in the conveying direction, the upstream partial lid and the downstream partial lid covering at least part of the opening;

a sheet feed tray provided in the sheet feeder device main unit, the transfer medium being loaded onto the sheet feed tray;

an elevating unit configured to lift up and down the sheet feed tray; and a control unit configured to control the lifting up and down of the sheet feed tray, wherein the control unit senses opening and closing of the upstream partial lid and the downstream partial lid, and controls the lifting up and down being performed by the elevating unit in accordance with a result of the sensing.

According to the sheet feeder device of another aspect, the control unit preferably sets at least one lowering position to which the sheet feed tray can be lowered by the elevating unit in accordance with the result of the sensing.

According to the sheet feeder device of another aspect, a long transfer medium loaded onto the sheet feed tray can be preferably partially loaded onto the downstream partial lid, the long transfer medium being longer than a storage recess in the sheet feed tray, the long transfer medium being prepared for sheet feeding.

According to the sheet feeder device of another aspect, the control unit preferably sets at least an intermediate position and a lowermost position as the at least one lowering position.

According to the sheet feeder device of another aspect, the intermediate position is preferably based on a height of a top portion of the transfer medium loaded onto the sheet feed tray.

According to the sheet feeder device of another aspect, the intermediate position is preferably at a height at which a long transfer medium is loaded onto the sheet feed tray.

According to the sheet feeder device of another aspect, the control unit preferably sets a standby position as the at least one lowering position.

According to the sheet feeder device of another aspect, when the downstream partial lid is opened and the upstream partial lid is closed, the control unit preferably sets the lowermost position of the sheet feed tray as the at least one lowering position to which the sheet feed tray can be lowered, and when the upstream partial lid and the downstream partial lid are opened, the control unit preferably sets the intermediate position as the at least one lowering position to which the sheet feed tray can be lowered.

According to the sheet feeder device of another aspect, the control unit preferably sets a height of the intermediate position in accordance with a type of a transfer medium loaded onto the upstream partial lid.

According to the sheet feeder device of another aspect, the type of the transfer medium is preferably indicated by a basis weight.

According to the sheet feeder device of another aspect, the result of the sensing preferably further includes existence/nonexistence of a transfer medium loaded onto the upstream partial lid.

According to the sheet feeder device of another aspect, the sheet feeder device preferably further comprises a transfer medium sensing unit configured to sense a transfer medium loaded onto the upstream partial lid.

According to the sheet feeder device of another aspect, when the transfer medium loaded onto the upstream partial lid is sensed, the control unit preferably prohibits lowering of the sheet feed tray.

According to the sheet feeder device of another aspect, when the transfer medium loaded onto the upstream partial lid is sensed, the control unit preferably prohibits a sheet feeding operation while the downstream partial lid is opened.

According to the sheet feeder device of another aspect, the partial lids are preferably formed with double doors or sliding doors.

According to the sheet feeder device of another aspect, the sheet feeder device preferably further comprises a tray height sensing unit configured to sense a height of the sheet feed tray.

According to the sheet feeder device of another aspect, the tray height sensing unit preferably performs the sensing in accordance with a height of a top portion of the transfer medium loaded onto the sheet feed tray.

According to the sheet feeder device of another aspect, between the upstream partial lid and the downstream partial lid, the downstream partial lid is preferably preferentially opened.

According to the sheet feeder device of another aspect, the downstream partial lid preferably has a portion overlapping on the upstream partial lid when closed.

To achieve the abovementioned object, according to an aspect, an image forming apparatus reflecting one aspect of the present invention comprises a sheet feeder device configured to store and send out a transfer medium, the sheet feeder device including:

a sheet feeder device main unit having an opening formed at an upper portion, the sheet feeder device main unit including an upstream partial lid located on an upstream side in a conveying direction and a downstream partial lid located on a downstream side in the conveying direction, the upstream partial lid and the downstream partial lid being located in the opening;

a sheet feed tray provided in the sheet feeder device main unit, a transfer medium being loaded onto the sheet feed tray;

an elevating unit configured to lift up and down the sheet feed tray; and a control unit configured to control the lifting up and down of the sheet feed tray, wherein the control unit senses opening and closing of the upstream partial lid and the downstream partial lid, and controls the lifting up and down being performed by the elevating unit in accordance with a result of the sensing.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an image forming apparatus according to an embodiment of the present invention will be described with reference to the drawings. However, the scope of the invention is not limited to the illustrated examples.

Figure 1:
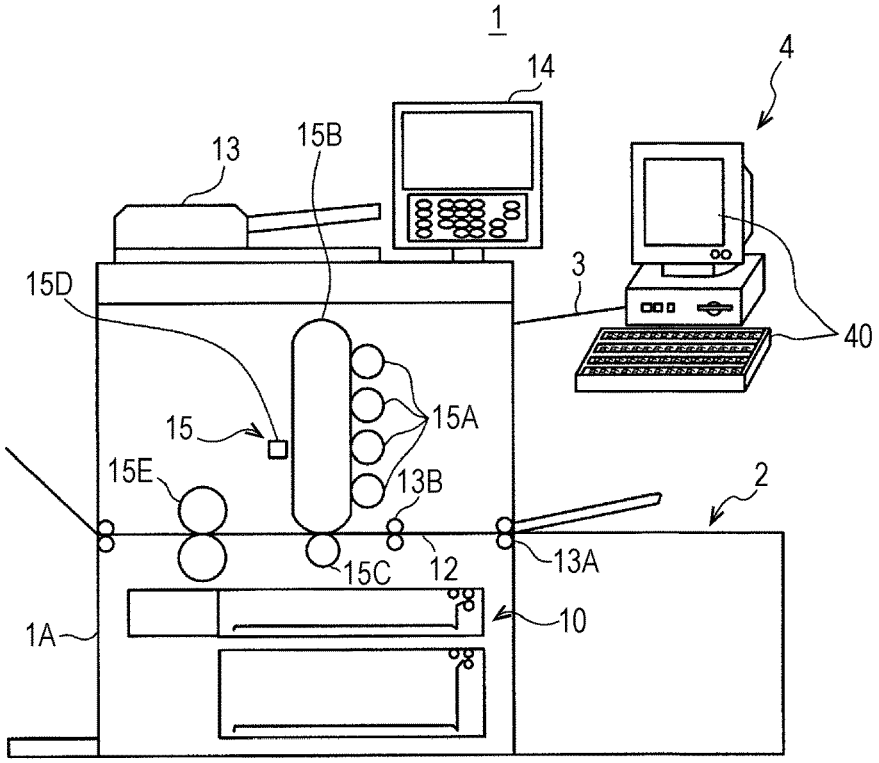
FIG. 1 is a schematic view of a sheet feeder device and an image forming apparatus according to an embodiment of the present invention.

FIG. 1 shows the mechanical structure and the outline of the image forming apparatus according to an embodiment of the present invention.

An image forming apparatus 1 includes an image forming apparatus main unit 1A, and a sheet feeder device 2 is connected to the previous stage side of the image forming apparatus main unit 1A. Although any post-processing device is not provided on the subsequent side of the image forming apparatus main unit 1A in this embodiment, a post-processing device may be provided. Appropriate paper sheets are stored in the sheet feeder device 2. In this embodiment, each paper sheet is equivalent to a transfer medium. The transfer medium is not limited to paper, and may be formed with a fabric, plastic, or the like. The material of the transfer medium is not limited to any particular material, either.

Furthermore, in this embodiment, the image forming apparatus 1 is formed with the image forming apparatus main unit 1A and a device connected to the image forming apparatus main unit 1A. However, the type and the number of devices connected to the image forming apparatus main unit 1A are not limited to any particular type and any specific number. Furthermore, the image forming apparatus 1 may be formed only with the main unit 1A.

The sheet feeder device 2 may be included in the image forming apparatus 1, or may be used as an external device connected to the image forming apparatus 1. In this embodiment, the sheet feeder device 2 is included in the image forming apparatus 1.

In the image forming apparatus 1, the image forming apparatus main unit 1A includes an image forming unit 15 that forms an image. An operation panel 14 that accepts an operation from an operator and displays information is provided on the upper side of the image forming apparatus main unit 1A. The operation panel 14 can be formed with an LCD having a touch panel, for example. Alternatively, an operating unit at which operations are performed, and a display unit that displays information may be formed separately from each other. Through the operation panel 14, a setting can be performed on paper sheets stored in a sheet feeding main unit tray 10 or in the sheet feeder device 2.

Further, a document reading unit 13 that automatically reads a document and includes an automatic document feeder is provided on the upper side of the main unit 1A of the image forming apparatus 1. An image of a document is read by the document reading unit 13. Furthermore, sheet feeding main unit trays 10 that store paper sheets are provided on the lower side of the image forming apparatus main unit 1A.

The image forming apparatus main unit 1A has a conveyance path 12 in which paper sheets are conveyed. Paper sheets may be supplied from the sheet feeding main unit trays 10 in the main unit 1A, or may be supplied from the sheet feeder device 2. A paper sheet supplied from a sheet feeding main unit tray 10 or the sheet feeder device 2 is conveyed in the conveyance path 12 via conveying rollers 13A and 13B, and the like, and is led to the image forming unit 15. At the image forming unit 15, an image is transferred onto the paper sheet, and heat and pressure are applied to the image by a fixing unit 15E. Thus, a toner image is fixed, and printing is completed. After that, the paper sheet is discharged from the apparatus through the conveyance path 12. A paper sheet of this embodiment is equivalent to a transfer medium according to an embodiment of the present invention. The transfer medium is not necessarily a paper sheet, and may be formed with a fabric or the like. Furthermore, a paper sheet on which an image has been formed may be conveyed to a post-processing device.

Although not shown in the drawing, a reverse conveyance path branches on the downstream side of the fixing unit 15E, and the reverse conveyance path joins the conveyance path 12 on the upstream side of the image forming unit 15. In a case where images are to be formed on the front and back surfaces, a paper sheet having an image formed on the front surface thereof is conveyed to the reverse conveyance path. After reversed in the reverse conveyance path, the paper sheet is conveyed to the conveyance path 12, so that an image can be formed on the back surface.

The mechanism for forming an image on the back surface of a paper sheet is not limited to the above mechanism, and an image forming unit for the back surface may also be provided.

The image forming unit 15 includes photosensitive members 15A prepared for the respective colors (cyan, magenta, yellow, and black, for example). A charging unit, a write unit, and a developing unit that are not shown in the drawing are provided in the vicinity of each of the photosensitive members 15A. The surface of each photosensitive member 15A electrically charged by the charging unit is subjected to image exposure based on image data information by the write unit such as an LD, so that a latent image is formed on the surface of the photosensitive member 15A. The latent image is developed by the developing unit, and is turned into a toner image. The toner image is transferred onto an intermediate transfer belt 15B, and the image on the intermediate transfer belt 15B is then transferred onto a paper sheet that is being conveyed in the conveyance path 12 while being pressed by a secondary transfer roller 15C.

In the image forming unit 15, a cleaning blade 15D that removes residual toner on the intermediate transfer belt 15B is provided on the downstream side of the image transfer position of the intermediate transfer belt 15B in the rotating direction and on the upstream side of the positions of image transfer from the respective photosensitive members 15A.

The above described photosensitive members 15A and the intermediate transfer belt 15B are rotated by a drive motor (not shown). An image transferred onto a paper sheet is fixed by the fixing unit 15E, and thus, printing is completed. In a case where printing is to be performed only on the front surface of a paper sheet, the paper sheet is conveyed along the conveyance path 12 after the image formation, and is discharged from the apparatus.

In a case where printing is also to be performed on the back surface of the paper sheet, the paper sheet is sent into the reverse conveyance path, and is reversed. The paper sheet is then returned to the conveyance path 12 on the upstream side of the image forming unit 15. An image is transferred onto the back surface of the returned paper sheet in the same manner as above. After the image is fixed by the fixing unit 15E, the paper sheet is conveyed along the conveyance path 12, and is discharged from the apparatus.

Although a color image forming apparatus is described in this embodiment, the image forming apparatus 1 may be a monochrome image forming apparatus.

The image forming apparatus 1 is connected to an external device 4 via a LAN 3, and thus forms an image forming system. The external device 4 may be a PC terminal, or a management device that manages the image forming apparatus 1, for example. Image data may be obtained by the image forming apparatus 1, or may be obtained from job data sent from the external device 4. The job data may include image data, printing conditions data, and the like. In a case where the external device 4 is used as a device that manages the image forming apparatus 1, the sheet feeder device 2 can be controlled by a control unit in the external device 4.

Figure 2:
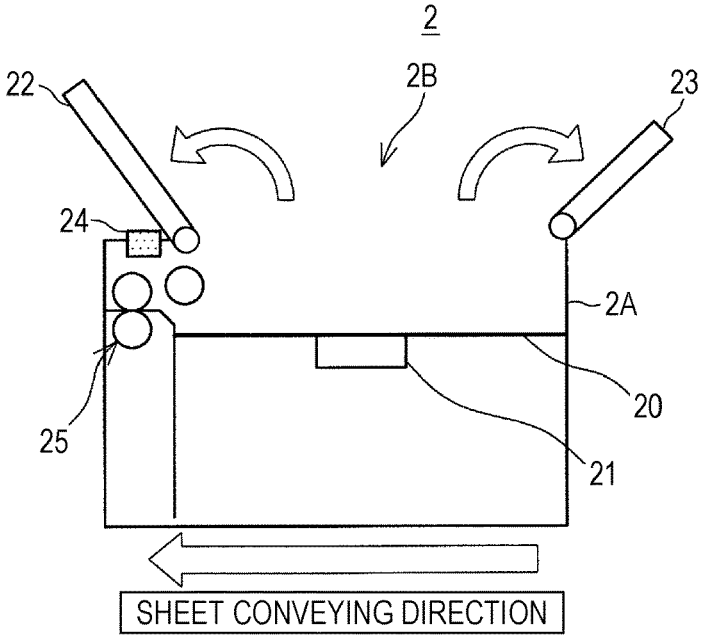
FIG. 2 is a diagram schematically showing the structure of the sheet feeder device according to the embodiment.

FIG. 2 schematically shows the mechanical structure of the sheet feeder device 2.

The sheet feeder device 2 includes a sheet feeder device main unit 2A that stores transfer media, and has an opening 2B at the upper portion.

The sheet feeder device main unit 2A includes a sheet feed tray 20 onto which paper sheets can be loaded. The sheet feed tray 20 can move up and down in the sheet feeder device main unit 2A by virtue of an elevating unit 21.

The elevating unit 21 can be formed with a drive motor, a drive force transmission mechanism, and the like that are not shown in the drawing. The elevating unit 21 should be capable of lifting up and down the sheet feed tray 20, but the structure of the elevating unit 21 according to the present invention is not limited to any particular structure.

The sheet feed tray 20 is elevated by the elevating unit 21 so that the upper surface of the uppermost paper sheet on the sheet feed tray 20 is located in the sheet feeding position. In this manner, the sheet feeding position can be fixed at a certain height. The uppermost paper sheet is then supplied by a sheet feeding unit 25 that includes sheet feed rollers or the like.

The opening 2B can be covered with a downstream partial lid 22 located on the downstream side in the sheet conveying direction and an upstream partial lid 23 located on the upstream side. Each partial lid is supported on a shaft at both ends of the upper portion of the sheet feeder device main unit 2A in the conveying direction. The partial lids can be opened and closed like double doors, with the shaft-supported portions being the points of support. The downstream partial lid 22 and the upstream partial lid 23 may cover the entire opening 2B, or may cover part of the opening 2B.

Figure 3:
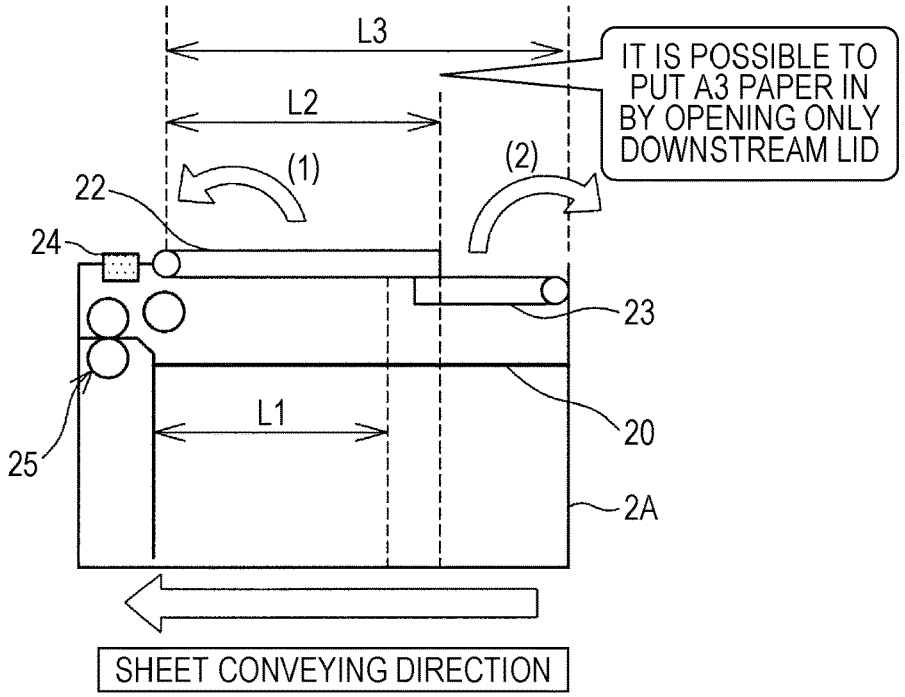
FIG. 3 is a diagram showing the length of the storage recess in the sheet feeder device according to the embodiment.

As shown in FIG. 3, when the downstream partial lid 22 and the upstream partial lid 23 are closed, the downstream partial lid 22 is always located in a higher position than the upstream partial lid 23. With this configuration, the user first opens the downstream partial lid 22 when opening the partial lids.

In this embodiment, the entire downstream partial lid 22 is located in a higher position than the upstream partial lid 23, to restrict the opening/closing order to a certain order. However, the configuration for determining the opening/closing order is not limited to the above configuration. For example, when both partial lids are closed, the edges of the lids overlap each other, and the edge of the downstream lid may overlap on the edge of the upstream lid. Some other configuration may also be employed.

The sheet feeder device main unit 2A also includes a manual lowering switch 24 for issuing an instruction to lower the sheet feed tray 20. As the user operates the lowering switch 24, the sheet feed tray 20 can be lowered by the elevating unit 21. Through the lowering, the sheet feed tray 20 may be adjusted to a certain height. As the sheet feed tray 20 is lowered, paper sheets can be loaded onto the sheet feed tray 20 through the opening 2B.

The sheet feeder device main unit 2A has such a size L1 that paper sheets can be put into or pulled out of the sheet feeder device main unit 2A when the downstream partial lid 22 is opened. The length L1 is set at 430 mm or greater, for example, so that A3 paper can be used. Therefore, the length L2 of the downstream partial lid 22 should be greater than L1, and may be 500 mm or greater, for example. The sheet feeder device main unit 2A also has such a length L3 that paper sheets with a maximum length can be stored thereinto when the downstream partial lid 22 and the upstream partial lid 23 are open. For example, the length L3 may be approximately 750 mm.

When opened rotatively about the upstream point of support, the upstream partial lid 23 is stopped at an obtuse angle with respect to the sheet feed tray 20.

When the user loads a long paper sheet of a size that fits the sheet feeder device 2 onto the sheet feed tray 20, the downstream partial lid 22 and the upstream partial lid 23 are opened.

In this condition, a long paper sheet that fits the sheet feeder device 2 is used, and is stopped in an intermediate position. Therefore, there is no need to set the long paper sheet in a deep position, and the long paper sheet can be easily loaded onto the sheet feed tray 20. Further, the weight to be loaded on the sheet feed tray 20 is limited to a certain weight, so that the elevating operation for an A3/A4 sheet feeder device can also be used for the long paper sheet.

Figure 4:
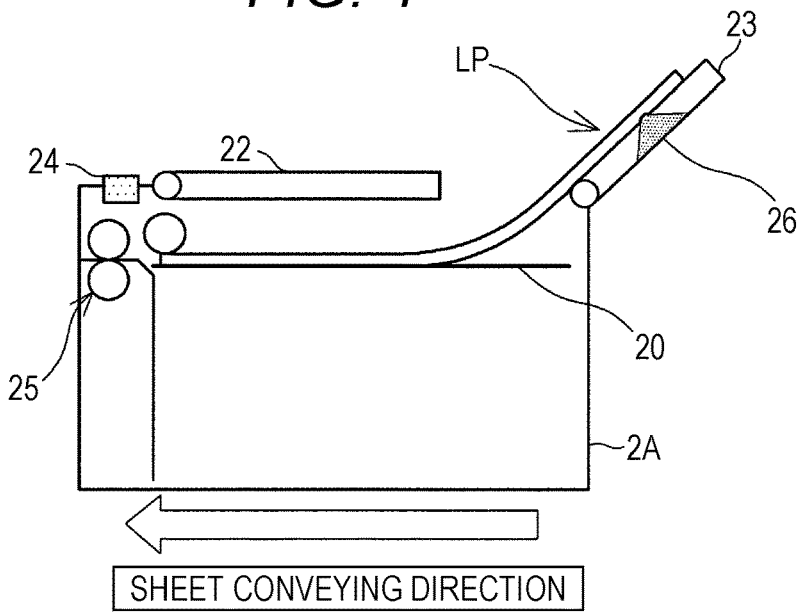
FIG. 4 is a diagram showing a situation where a long paper sheet is set on the sheet feeder device according to the embodiment.

As shown in FIG. 4, a long paper sheet LP can be loaded onto both the sheet feed tray 20 and the opened upstream partial lid 23.

When the user loads a paper sheet of a length that is greater than the length of the storage recess in the sheet feeder device 2 onto the sheet feed tray 20, the downstream partial lid 22 and the upstream partial lid 23 are opened.

The upstream partial lid 23 has a sheet sensing unit 26 that senses the paper sheet loaded onto the upstream partial lid 23. The sheet sensing unit 26 is formed with an optical sensor or the like, and can sense the existence of the paper sheet. However, the structure of the sheet sensing unit 26 is not limited to any particular structure in the present invention, as long as the sheet sensing unit 26 can sense the existence/nonexistence of a paper sheet on the upstream partial lid 23.

The sheet feeder device 2 further includes a tray height sensing unit 27 (shown in FIG. 5) that senses the height of the sheet feed tray 20. The tray height sensing unit 27 can sense the height of the sheet feed tray 20 or the height of the upper surface of a paper sheet with a sensor provided at an appropriate location. The tray height sensing unit 27 may also calculate the height of the sheet feed tray 20 or the height of the upper surface of the paper sheet in accordance with the quantity of motion of the elevating unit 21. In the present invention, the structure of the tray height sensing unit 27 is not limited to any particular structure, as long as the height of the sheet feed tray 20 or the height of the upper surface of the paper sheet can be sensed.

Figure 5:
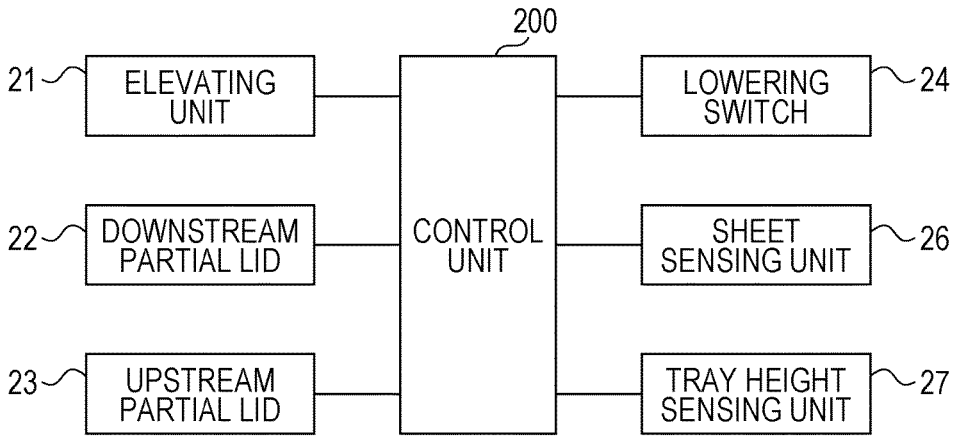
FIG. 5 is a diagram showing the control block of the sheet feeder device according to the embodiment.

FIG. 5 shows the control block in the sheet feeder device 2.

The sheet feeder device 2 may be controlled by an image formation control unit included in the apparatus main unit 1A, or may be controlled by a sheet feed control unit included in the sheet feeder device 2. The image formation control unit or the sheet feed control unit that controls the sheet feeder device 2 is equivalent to a control unit according to an embodiment of the present invention. Alternatively, the image formation control unit and the sheet feed control unit may cooperate with each other, to form a control unit according to an embodiment of the present invention.

The elevating unit 21 is connected to a control unit 200 in a controllable manner. In accordance with a control instruction from the control unit 200, the elevating unit 21 performs an elevating operation.

An open sensor (not shown) for the downstream partial lid 22 is connected to the control unit 200 in a controllable manner, and a signal from the open sensor for the downstream partial lid 22 is transmitted to the control unit 200. A close sensor may also be provided, and a signal from the close sensor may be transmitted to the control unit 200.

An open sensor (not shown) for the upstream partial lid 23 is connected to the control unit 200 in a controllable manner, and a signal from the open sensor for the upstream partial lid 23 is transmitted to the control unit 200. A close sensor may also be provided, and a signal from the close sensor may be transmitted to the control unit 200.

An operation signal from the lowering switch 24 is also transmitted to the control unit 200. As the operation signal from the lowering switch 24 is input to the control unit 200, the control unit 200 controls the elevating unit 21 so that the sheet feed tray 20 is lowered to a predetermined position, for example.

The sheet sensing unit 26 is also connected to the control unit 200 in a controllable manner, and a result of sensing performed by the sheet sensing unit 26 is transmitted to the control unit 200.

The tray height sensing unit 27 is further connected to the control unit 200 in a controllable manner, and a result of sensing performed by the tray height sensing unit 27 is transmitted to the control unit 200.

The control unit 200 determines the positions to which the sheet feed tray 20 can be lowered, in accordance with the opened/closed states of the downstream partial lid 22 and the upstream partial lid 23. The possible lowering positions are stored in a nonvolatile memory or the like included in the control unit 200. The possible lowering positions may be set by the user through the operation panel 14. Alternatively, the sheet feeder device 2 may be equipped with an operation panel to accept an operation performed by the user.

Figure 6:
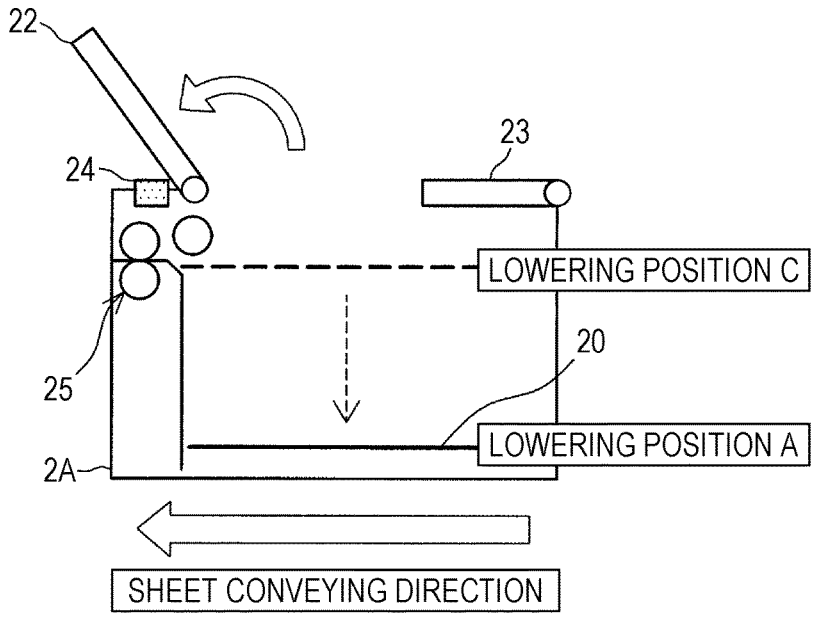
FIG. 6 is a diagram showing a situation where only a downstream partial lid of the sheet feeder device according to the embodiment is opened, and positions to which a sheet feed tray can be lowered.

FIG. 6 shows a lowering position C and a lowering position A to which the sheet feed tray 20 can be lowered when the downstream partial lid 22 is opened.

To load paper sheets of A3 or smaller onto the sheet feed tray 20, the user opens only the downstream partial lid 22. When only the downstream partial lid 22 is opened, the sheet feed tray 20 is temporarily stopped in the lowering position C on the upper side. If the user then presses the lowering switch 24 for loading paper sheets onto the sheet feed tray 20, the sheet feed tray 20 is lowered to the lowermost lowering position A.

When loading paper sheets of A3 or smaller onto the sheet feed tray 20, the user performs an operation in this condition. In this manner, a large number of paper sheets of a standard size can be readily loaded onto the sheet feed tray 20.

The lowering position C is equivalent to the standby position. The position of the top portion of a possible paper stack in the standby position is slightly lower than the sheet feeding position. As the position of the top portion of the possible paper stack is slightly lower than the sheet feeding position, a paper jam at the sheet feeding unit 25 can be cleared, for example. In this embodiment, when the downstream partial lid 22 is opened, a signal from the open sensor for the downstream partial lid 22 is transmitted to the control unit 200. In accordance with this signal, the control unit 200 performs control to lower the sheet feed tray 20 so that the top portion of the possible paper stack on the sheet feed tray 20 is located at the same height as the lowering position C.

When the lowering switch 24 is operated while the downstream partial lid 22 is opened but the upstream partial lid 23 is closed, a signal from the open sensor for the downstream partial lid 22 and an operation signal from the lowering switch 24 are transmitted to the control unit 200. In accordance with these signals, the control unit 200 lowers the sheet feed tray 20 to the lowering position A on the lower side. The lowering position A is the lowermost position of the sheet feed tray 20.

Figure 7:
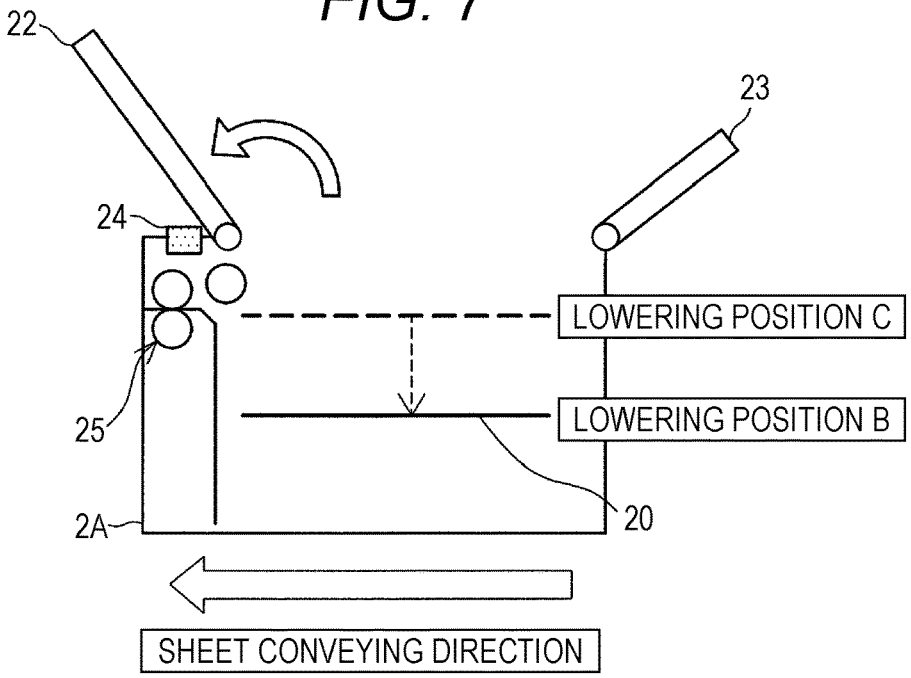
FIG. 7 is a diagram showing a situation where both of the partial lids of the sheet feeder device according to the embodiment are opened, and positions to which the sheet feed tray can be lowered.

FIG. 7 shows the lowering position C and a lowering position B to which the sheet feed tray 20 can be lowered in a situation where the downstream partial lid 22 and the upstream partial lid 23 are opened.

In this situation, the sheet feed tray 20 is lowered, and the position of the top portion of a possible paper stack is temporarily stopped at the same height as the lowering position C on the upper side. If the user then presses the lowering switch 24 for loading paper sheets onto the sheet feed tray 20, the sheet feed tray 20 is lowered so that the position of the top portion of a possible paper stack is at the same height as the lowering position B. The lowering position B is equivalent to an intermediate position according to an embodiment of the present invention.

In a situation where the downstream partial lid 22 and the upstream partial lid 23 are opened, a signal from the open sensor for the downstream partial lid 22 is transmitted to the control unit 200 in the same manner as above. In accordance with this signal, the control unit 200 performs control to lower the sheet feed tray 20 so that the top portion of the possible paper stack on the sheet feed tray 20 is located at the same height as the lowering position C.

Furthermore, if the lowering switch 24 is pressed in this situation, the sheet feed tray 20 is lowered and then stopped so that the top portion of the possible paper stack on the sheet feed tray 20 is located at the same height as the lowering position B. The lowering position B is based on the height of the top portion of the possible paper stack on the sheet feed tray 20, and is at such a height that a long paper sheet LP can be set on the sheet feed tray 20 and the upstream partial lid 23. Therefore, if the paper stack on the sheet feed tray 20 varies, the position in which the sheet feed tray 20 should be stopped also varies.

The height of the intermediate position can be changed in accordance with the type of the long paper sheet LP. A paper type is typically indicated by a basis weight. Normally, a paper sheet with a large basis weight is not easily wrinkled, and a paper sheet with a small basis weight is easily wrinkled. Accordingly, the intermediate position for a paper sheet with a large basis weight can be made lower than the intermediate position for a paper sheet with a small basis weight.

Figure 8:
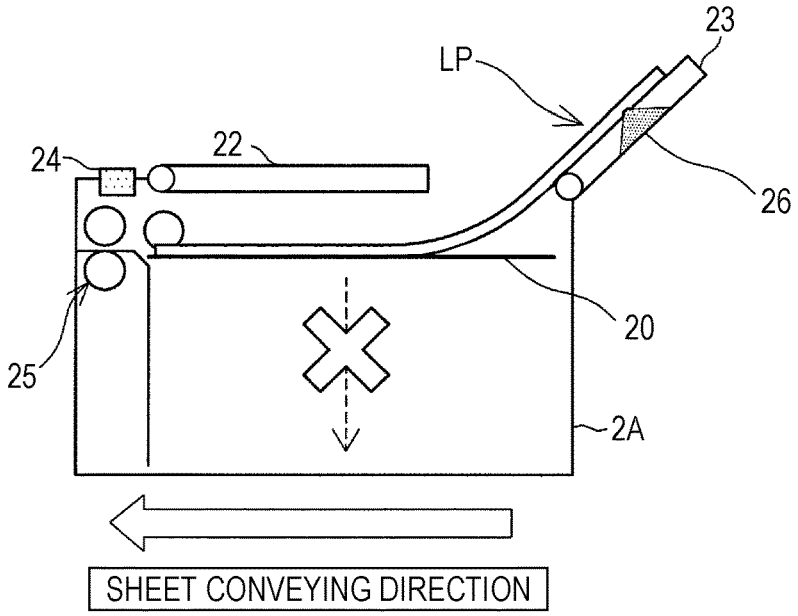
FIG. 8 is a diagram showing a situation where only an upstream partial lid of the sheet feeder device according to the embodiment is opened, and a long paper sheet is set on the sheet feed tray and the upstream partial lid.

FIG. 8 shows a situation where the upstream partial lid 23 is opened, and a long paper sheet LP is set on the sheet feed tray 20 and the upstream partial lid 23.

In this situation, the top portion of the possible paper stack on the sheet feed tray 20 is lowered and is temporarily stopped at the same height as the lowering position C. Accordingly, the user can load a long paper sheet onto the upstream partial lid 23 and the sheet feed tray 20, without any wrinkle or bend.

As a paper sheet is loaded onto the upstream partial lid 23, the existence of the paper sheet is sensed by the sheet sensing unit 26 provided in the upstream partial lid 23. The sheet sensing unit 26 is equivalent to a transfer medium sensing unit according to an embodiment of the present invention.

Even if the user presses the lowering switch 24 to load paper sheets onto the sheet feed tray 20 in this situation, the sheet feed tray 20 is not lowered.

When a long paper sheet is set in this condition, the sheet feed tray 20 needs to be fixed so that the top portion of the possible paper stack is located at the same height as the lowering position C. In the lowering position C, the long paper sheet does not excessively sag between the sheet feed tray 20 and the upstream partial lid 23, and accordingly, the long paper sheet can be prevented from being bent or wrinkled. In view of this, it is necessary to restrict lowering of the sheet feed tray 20.

In this situation, the existence of the long paper sheet LP is sensed by the sheet sensing unit 26, and a result of the sensing performed by the sheet sensing unit 26 is transmitted to the control unit 200.

In accordance with the result of the sensing performed by the sheet sensing unit 26, the control unit 200 prohibits lowering of the sheet feed tray 20. As a result, the sheet feed tray 20 is not lowered any further, even if the lowering switch 24 is pressed in this situation.

The lowering position C varies with the basis weight of the set paper sheet. In the case of thick paper (a paper sheet of approximately 170 g/m$^2$ or more), a wide lowering range is secured. In the case of thin paper (a paper sheet of approximately 60 g/m$^2$ or less), the lowering range is narrowed. In this manner, the tray can be stopped in a suitable loading position for the paper sheet to be used.

The downstream partial lid 22 can be closed after the upstream partial lid 23 is opened. Any sheet feeding operation may be prohibited unless the downstream partial lid 22 is closed.

Figure 9:
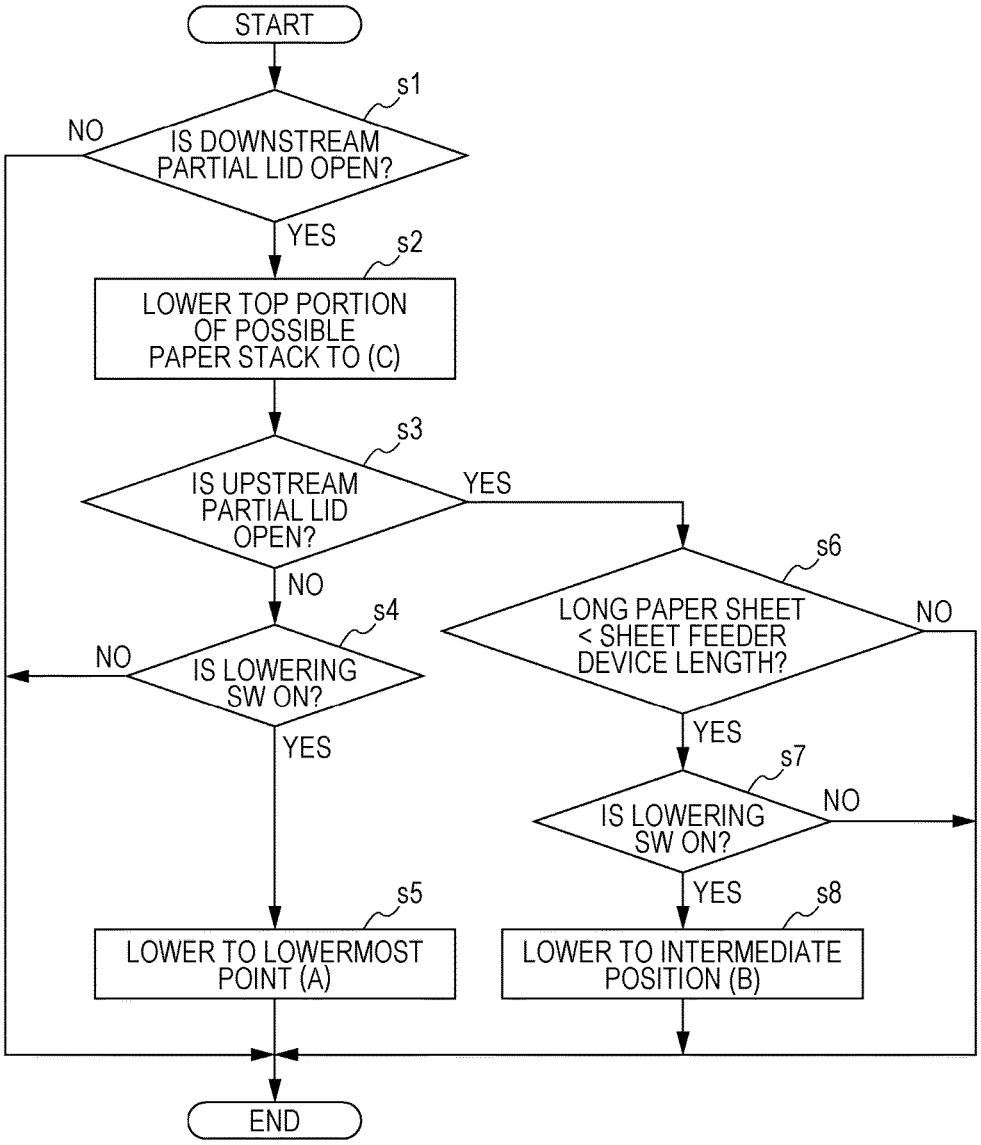
FIG. 9 is a flowchart showing the procedures for controlling lifting up and down of the sheet feed tray in accordance with the opened/closed states of the partial lids and the existence/nonexistence of a long paper sheet.

Referring now to the flowchart in FIG. 9, the procedures for controlling lifting up and down of the sheet feed tray 20 are described.

At the start of control, a check is made to determine whether the downstream partial lid 22 is opened (step s1). If the downstream partial lid 22 is not opened (No in step s1), the process comes to an end.

If the downstream partial lid 22 is opened (Yes in step s1), the sheet feed tray 20 is lowered until the top portion of the possible paper stack on the sheet feed tray 20 is located in the lowering position C (step s2).

A check is then made to determine whether the upstream partial lid 23 is opened (step s3). If the upstream partial lid 23 is not opened (No in step s3), a check is made to determine whether the lowering switch 24 has been turned on (step s4). If the lowering switch 24 has not been turned on (No in step s4), the process comes to an end. If the lowering switch 24 has been turned on (Yes in step s4), the sheet feed tray 20 is lowered to the lowermost lowering position A (step s5), and the process then comes to an end.

If the upstream partial lid 23 is opened in step s3 (Yes in step s3), a check is made to determine whether the length of the long paper sheet is greater than the length of the sheet feeder device 2 (step s6). The determination depends on whether the long paper sheet is sensed by the sheet sensing unit 26. Specifically, if the long paper sheet is sensed by the sheet sensing unit 26, the length of the long paper sheet can be determined to be greater than the length of the sheet feeder device 2. If the long paper sheet is not sensed by the sheet sensing unit 26, the length of the long paper sheet can be determined not to be greater than the length of the sheet feeder device 2.

If the length of the long paper sheet is smaller than the length of the sheet feeder device 2 (Yes in step s6), a check is made to determine whether the lowering switch 24 has been turned on (step s7). If the lowering switch 24 has been turned on (Yes in step s7), the sheet feed tray 20 is lowered so that the top portion of the possible paper stack on the sheet feed tray 20 is located in the intermediate position (step s8), and the process then comes to an end.

If the length of the long paper sheet is greater than the length of the sheet feeder device 2 (No in step s6), lowering of the sheet feed tray 20 is prohibited, and the process comes to an end.

If a sheet feed instruction is issued after the above control on the lowering operation, the control unit 200 can perform control to lift up the sheet feed tray 20 so that the top portion of the possible paper stack is located in the sheet feeding position, and the sheet supply can be started.

If the downstream partial lid 22 is not closed at the time of the sheet supply, the sheet supply is prohibited. If the downstream partial lid 22 is closed, the sheet supply is allowed. In this way, in a case where a paper sheet is loaded onto the sheet feed tray 20 and a lid, the upper portion of the sheet feeding unit can cover the opening with the downstream partial lid 22, and thus, safety in the sheet supply can be maintained.

This embodiment provides a structure that sets a paper sheet by opening upper partial lids in a sheet feeder device that supplies paper sheets to an image forming apparatus main unit, and a mechanism for maintaining a sheet loading member at a predetermined height in a sheet feeding position. When the paper sheet is loaded onto the loading member, the loading member is lowered. After the upper lids are opened or a lid is opened, a lowering switch is operated, and the paper sheet is loaded onto the loading member.

Furthermore, in this embodiment, an opening is formed in an upper portion of the sheet feeder device, and partial lids for covering the opening are provided. Each of the lids has a rotative point of support at both ends. The sheet feeder device includes a control unit that changes positions to which an elevating tray can be lowered in a situation where only the downstream lid is opened, where the downstream lid and the upstream lid are opened, and where the downstream lid and the upstream lid are opened to allow a long paper sheet to be loaded onto the upstream lid and the elevating tray.

As the opened/closed states of the opening lids and the lowering position of the elevating tray are controlled, a suitable loading state for the size of the paper sheet to be used by the user can be created. Furthermore, the state of the sheet loading performed by the user is also reflected by the possible lowering position of the elevating tray. Accordingly, the paper sheet can be prevented from being bent or wrinkled due to an incorrect operation performed by the user, and user-friendliness can also be increased.

Although the present invention has been described in accordance with the above embodiments, modifications may be made to the embodiments as appropriate without departing from the scope of the present invention.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A sheet feeder device that stores and sends out a transfer medium, comprising:

a sheet feeder device main unit having an opening formed at an upper portion, the sheet feeder device main unit including an upstream partial lid located on an upstream side in a conveying direction and a downstream partial lid located on a downstream side in the conveying direction, the upstream partial lid and the downstream partial lid covering at least part of the opening;

a sheet feed tray provided in the sheet feeder device main unit, the transfer medium being loaded onto the sheet feed tray;

an elevating unit configured to lift up and down the sheet feed tray; and a control unit configured to control the lifting up and down of the sheet feed tray, wherein the control unit senses opening and closing of the upstream partial lid and the downstream partial lid, and controls the lifting up and down being performed by the elevating unit in accordance with a result of the sensing;

wherein the result of the sensing further includes existence/nonexistence of a transfer medium loaded onto the upstream partial lid.

2. The sheet feeder device according to claim 1, wherein the control unit sets at least one lowering position to which the sheet feed tray can be lowered by the elevating unit in accordance with the result of the sensing.

3. The sheet feeder device according to claim 2, wherein the control unit sets at least an intermediate position and a lowermost position as the at least one lowering position.

4. The sheet feeder device according to claim 3, wherein the intermediate position is based on a height of a top portion of the transfer medium loaded onto the sheet feed tray.

5. The sheet feeder device according to claim 4, wherein the intermediate position is at a height at which a long transfer medium is loaded onto the sheet feed tray.

6. The sheet feeder device according to claim 3, wherein the control unit sets a standby position as the at least one lowering position.

7. The sheet feeder device according to claim 3, wherein when the downstream partial lid is opened and the upstream partial lid is closed, the control unit sets the lowermost position of the sheet feed tray as the at least one lowering position to which the sheet feed tray can be lowered, and when the upstream partial lid and the downstream partial lid are opened, the control unit sets the intermediate position as the at least one lowering position to which the sheet feed tray can be lowered.

8. The sheet feeder device according to claim 3, wherein the control unit sets a height of the intermediate position in accordance with a type of a transfer medium loaded onto the upstream partial lid.

9. The sheet feeder device according to claim 8, wherein the control unit is configured to set a height of the intermediate position in accordance with a basis weight of a transfer medium loaded onto the upstream partial lid.

10. The sheet feeder device according to claim 1, wherein a long transfer medium loaded onto the sheet feed tray can be partially loaded onto the upstream partial lid, the long transfer medium being longer than a storage recess in the sheet feed tray, the long transfer medium being prepared for sheet feeding.

11. The sheet feeder device according to claim 1, further comprising a transfer medium sensing unit configured to sense a transfer medium loaded onto the upstream partial lid.

12. The sheet feeder device according to claim 1, wherein the partial lids are formed with double doors or sliding doors.

13. The sheet feeder device according to claim 1, further comprising a tray height sensing unit configured to sense a height of the sheet feed tray.

14. The sheet feeder device according to claim 13, wherein the tray height sensing unit performs the sensing in accordance with a height of a top portion of the transfer medium loaded onto the sheet feed tray.

15. The sheet feeder device according to claim 1, wherein, between the upstream partial lid and the downstream partial lid, the downstream partial lid is preferentially opened.

16. The sheet feeder device according to claim 1, wherein the downstream partial lid has a portion overlapping on the upstream partial lid when closed.

17. A sheet feeder device that stores and sends out a transfer medium, comprising:

a sheet feeder device main unit having an opening formed at an upper portion, the sheet feeder device main unit including an upstream partial lid located on an upstream side in a conveying direction and a downstream partial lid located on a downstream side in the conveying direction, the upstream partial lid and the downstream partial lid covering at least part of the opening;

a sheet feed tray provided in the sheet feeder device main unit, the transfer medium being loaded onto the sheet feed tray;

an elevating unit configured to lift up and down the sheet feed tray; and a control unit configured to control the lifting up and down of the sheet feed tray, wherein the control unit senses opening and closing of the upstream partial lid and the downstream partial lid, and controls the lifting up and down being performed by the elevating unit in accordance with a result of the sensing;

wherein the result of the sensing further includes existence/nonexistence of a transfer medium loaded onto the upstream partial lid; and wherein when the transfer medium loaded onto the upstream partial lid is sensed, the control unit prohibits lowering of the sheet feed tray.

18. The sheet feeder device according to claim 17, wherein, when the transfer medium loaded onto the upstream partial lid is sensed, the control unit prohibits a sheet feeding operation while the downstream partial lid is opened.

19. An image forming apparatus comprising a sheet feeder device configured to store and send out a transfer medium, the sheet feeder device comprising:

a sheet feeder device main unit having an opening formed at an upper portion, the sheet feeder device main unit including an upstream partial lid located on an upstream side in a conveying direction and a downstream partial lid located on a downstream side in the conveying direction, the upstream partial lid and the downstream partial lid being located in the opening;

a sheet feed tray provided in the sheet feeder device main unit, a transfer medium being loaded onto the sheet feed tray;

an elevating unit configured to lift up and down the sheet feed tray; and a control unit configured to control the lifting up and down of the sheet feed tray, wherein the control unit senses opening and closing of the upstream partial lid and the downstream partial lid, and controls the lifting up and down being performed by the elevating unit in accordance with a result of the sensing; and wherein the result of the sensing further includes existence/nonexistence of a transfer medium loaded onto the upstream partial lid.

* * * * *